US010070758B2

(12) United States Patent
Healy

(10) Patent No.: US 10,070,758 B2
(45) Date of Patent: Sep. 11, 2018

(54) SOAP GRIP

(71) Applicant: James W. Healy, Sandpoint, ID (US)

(72) Inventor: James W. Healy, Sandpoint, ID (US)

(73) Assignee: James Healy, Sandpoint, ID (US)

( * ) Notice: Subject to any disclaimer, the term of this patent is extended or adjusted under 35 U.S.C. 154(b) by 0 days.

(21) Appl. No.: 15/213,762

(22) Filed: Jul. 19, 2016

(65) Prior Publication Data

US 2018/0020883 A1 Jan. 25, 2018

(51) Int. Cl.
*A47K 5/04* (2006.01)

(52) U.S. Cl.
CPC ..... *A47K 5/04* (2013.01)

(58) Field of Classification Search
CPC ..... A47K 5/04; A47K 5/05; C11D 17/048
See application file for complete search history.

(56) References Cited

U.S. PATENT DOCUMENTS

| | | | | |
|---|---|---|---|---|
| 1,478,882 | A * | 12/1923 | Bailly | C11D 17/04 4/231 |
| 3,159,568 | A | 12/1964 | Needleman | |
| 4,062,792 | A * | 12/1977 | McNabb | C11D 17/048 401/201 |
| D259,064 | S | 4/1981 | Lee | |
| 4,480,939 | A | 11/1984 | Upton | |
| 4,741,852 | A * | 5/1988 | Ondracek | C11D 17/048 15/222 |
| 5,011,316 | A | 4/1991 | Damon | |
| 5,071,583 | A * | 12/1991 | Martell | C11D 17/04 401/88 |
| 5,207,725 | A | 5/1993 | Pinkerton | |
| 6,840,693 | B1 | 1/2005 | Bell | |
| 2008/0191120 | A1 | 8/2008 | Wright | |

FOREIGN PATENT DOCUMENTS

WO WO03079877 A1 10/2003

OTHER PUBLICATIONS

Notification of Transmittal of the International Search Report and the Written Opinion of the International Searching Authority, or the Declaration, dated Aug. 22, 2017, Application No. PCT/US17/42882.

* cited by examiner

*Primary Examiner* — Jennifer C Chiang
*Assistant Examiner* — Bradley Oliver
(74) *Attorney, Agent, or Firm* — Randall | Danskin, PS

(57) ABSTRACT

A soap grip for a bar of soap provides a flexible fabric gripping body that extends through a medial portion of a bar of soap so as to extend from a first end and a second end thereof, the gripping body provides finger holes extending outwardly from the ends of the bar of soap to allow for secure gripping of the bar of soap while bathing.

7 Claims, 4 Drawing Sheets

SOAP GRIP

TECHNICAL FIELD

The present invention relates generally to the field of toiletries. More specifically the instant invention is an insert within a bar of soap that provides a means for a user to firmly grasp and manipulate the bar of soap during showering, and providing a means for hanging the bar of soap, after use, to allow drying.

BACKGROUND OF THE INVENTION

Soap in bar form is perhaps the most common type of soap employed while bathing. The use of soap in this form has certain longstanding disadvantages. It is not possible for a bar of soap to be completely consumed because it eventually becomes so small as to become difficult to grasp. The majority of persons discard the bar of soap when it becomes so small.

Another characteristic of soap in bar form is its tendency to soften when kept in a soap tray or the like between periods of use. This softening reduces a bar of soap to a gelatinous consistency on its underside even when it is supported in a soap tray in such a way as to permit drainage of moisture and circulation of air therearound. Not only is such softening wasteful of soap, but it also renders the bar unpleasant in texture and feel.

Another problem with soap in bar form is that it is slippery when wet which makes the bar difficult to hold. In cases where the user s afflicted with arthritis or lacks hand/finger dexterity, it is difficult to grip a bar of soap even before it becomes slippery and virtually impossible to hold onto the bar after it gets wet. This is especially true as the bar of soap reduces in size after repeated uses. As a result, wet soap is often dropped. Sometimes the bar, when dropped, will break into pieces. When a person is handicapped in a way to make it difficult for him or her to retrieve the dropped bar of soap, the dropping becomes a serious problem instead of a mere annoyance.

One attempt to overcome the above described disadvantages has been to mold the bar of soap on a loop or length of rope, "soap on a rope." The loop of rope could be placed on a handle of the shower or tub fixture to suspend the soap to dry. When the ball or bar of soap become too small for further use, the remaining soap and loop were discarded.

A more recent means for overcoming the foregoing disadvantages can be seen in U.S. Pat. No. 4,480,939 which discloses a sack in which is carried a common sized bar of soap. The sack is formed of a mesh or knitted material such that moisture permeates therethrough to wet the bar of soap contained within the sack, and lather and the like may be transmitted from the inside of the sack to the outside to allow a user to lather himself/herself while bathing. The sack may be supported from a hook to encourage drying when not in use.

Another attempt to overcome the disadvantages of bar soap is disclosed in U.S. Pat. No. 5,207,725 which discloses a soap holder. The soap holder is a mesh type bag in which a bar of soap is carried. The bag carries a loop of synthetic material to suspend the bag containing the bar of soap when not in use.

My invention overcomes various of the aforementioned known drawbacks to bar soap by providing a soap grip that allows a bar of soap to be easily grasped, retained and manipulated, and also provides a means for hanging or otherwise suspending a bar of soap when not in use to promote drying. My soap grip is integrally formed with the bar of soap extending through a medial portion thereof, and my soap grip is tapered at a medial portion thereof so that even small bars of soap which have been repetitively used, remain useful while bathing to prevent waste.

SUMMARY OF THE INVENTION

A soap grip for a bar of soap provides a gripping body that extends through a medial portion of a bar of soap so as to extend from a first end and a second end thereof, the gripping body provides finger holes to allow for secure gripping of the bar of soap while bathing.

A first aspect of the invention is a soap grip for a body of soap, the body of soap having a first end, a second end, a first side, a second side, a top surface and a bottom surface with a medial portion between the opposing ends and the opposing sides. The soap grip provides a flexible planar gripping body having a first end, a second end, a first side and a second side with a width therebetween and the gripping body defines plural spaced apart holes between the first end and the second end and between the first side and the second side, and the gripping body is carried within the body of soap passing through the middle portion thereof so as to extend outwardly from an end of the body of soap, and one hole defined in the gripping body is outward of the end of the body of soap.

A second aspect of the invention is a soap grip that extends outwardly from both the first end and the second end of the body of soap, and a hole is defined in the gripping body outward of each end of the body of soap.

A third aspect of the invention is a soap grip that is formed of fabric.

A forth aspect of the invention is a soap grip wherein the width between the first side and the second side is reduced between the first end and the second end.

A fifth aspect of the invention is a soap grip wherein the holes defined in the gripping body are finger holes.

A sixth aspect of the invention is a soap grip having a surface texture extending entirely thereabout that enhances engagement with the body of soap.

A seventh aspect of the invention is a soap grip that is incorporated into a body of soap when the body of soap is formed.

An eighth aspect of the invention is a soap grip formed of a flexible generally planar fabric gripping body having a surface texture that enhances engagement with a body of soap, the gripping body having a first end and a second end, a first side and a second side with a width between the first side and the second side and the gripping body defines plural spaced apart finger holes between the first end and the second end and between the first side and the second side and the width of the body is reduced at a medial portion between the first end and the second end, and the body of soap has a first end, a second end, a first side, a second side, a top surface and a bottom surface with a medial portion between the first end and the second end and between the first side and the second side and between the top surface and the bottom surface, and the gripping body is carried within the body of soap and passes through the middle portion thereof so as to extend outwardly from the first end and the second end thereof, and one finger hole defined in the gripping body is positioned outwardly of each end of the body of soap so as to be accessible for gripping and manipulating the body of soap.

Other and further aspects of the invention are disclosed in the detailed description of the preferred embodiment which follows.

DETAILED DESCRIPTION OF THE PREFERRED EMBODIMENTS

Figure 1:
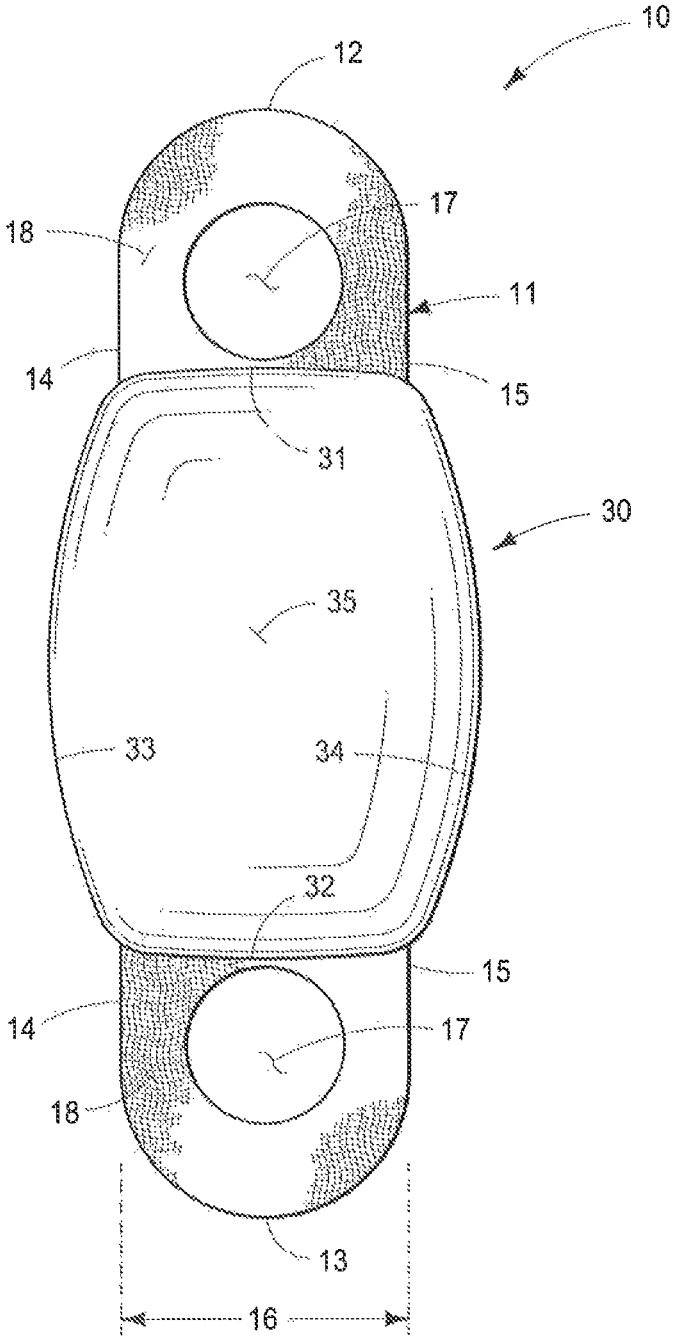
FIG. 1 is an orthographic top, downward looking view of the soap grip embedded within a bar of soap showing the invention as it would upon use.

This disclosure of the invention is submitted in furtherance of the constitutional purposes of the U.S. Patent Laws "to promote the progress of science and useful arts" (Article 1, Section 8).

A soap grip 10 for a body of soap 30 generally provides a gripping body 11 having a first end 12, an opposing second end 13, a first side 14, a second side 15 and a width 16 between the first side 14 and the second side 15. Plural finger holes 17 are defined in the gripping body 11 at spacedly arrayed positions between the first end 12 and the second end 13 and between the first side 14 and the second side 15.

The gripping body 11 is preferably formed of a flexible durable material having a surface texture 18 that enhances engagement with the body of soap 30 and that may enhance scrubbing when lathering. The gripping body 11 is preferably formed of a non-woven material which has the characteristics of being strong, durable, and not subject to degradation when wet, such as, but not limited to Tyvek® or cotton. Further, the non-woven material is chemically stable when subjected to known soap compositions and is not readily known as being a cause of skin allergies. The gripping body 11 is planar and is thin, having a thickness 20 of between approximately 0.5-3.0 mm.

Figure 3:
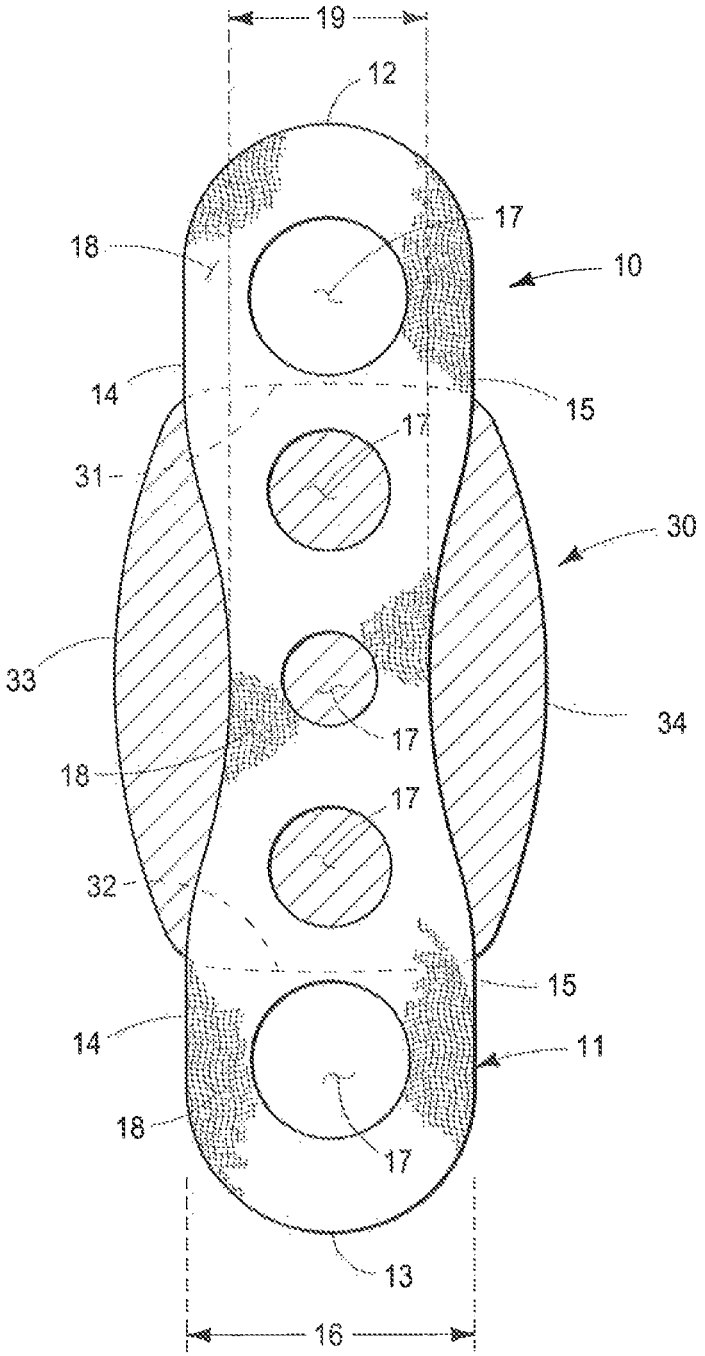
FIG. 3 is an orthographic partial cut-away, top, downward looking view, taken on line 3-3 of FIG. 2 showing the soap grip with the bar of soap, and showing the narrowing of the soap grip at a medial portion.

As shown in FIG. 3, the gripping body 11 is somewhat oval in shape with a narrower width 19 generally medially between the first end 12 and the second end 13.

The plural holes 17 defined in the gripping body 11 provide a means for gripping the body of soap 30 by a user inserting his/her fingers through the holes 17 so that the body of soap 30 and soap grip 10 is retained approximately within a user's palm and can be easily and securely manipulated during bathing for lathering of the body and the like.

Figure 4:
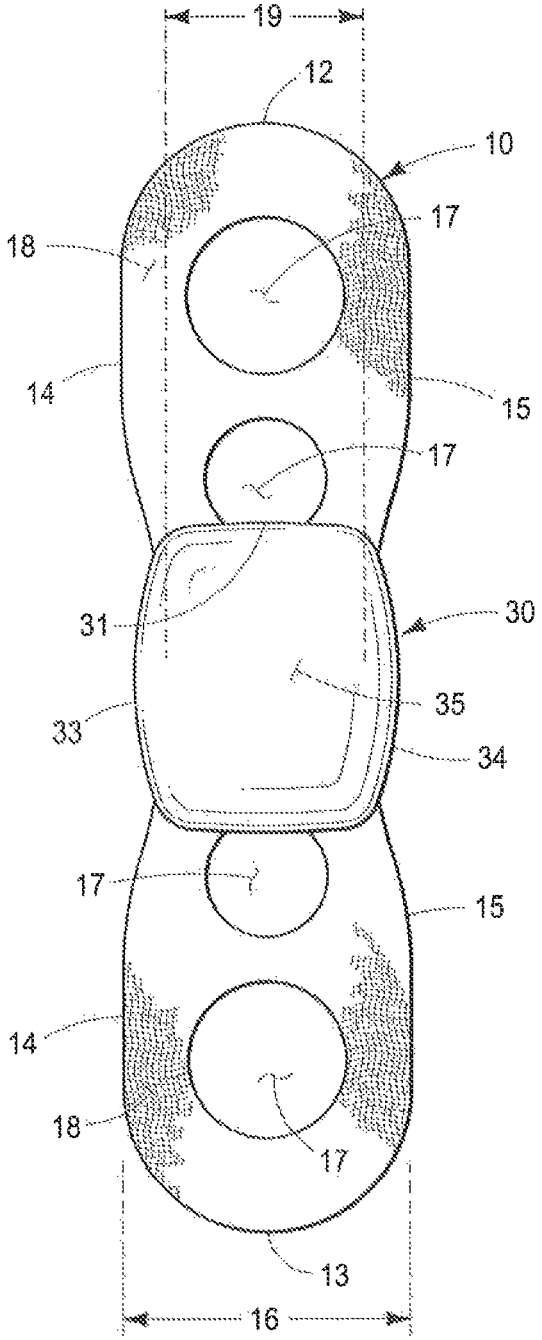
FIG. 4 is an orthographic, top, downward looking view similar to that of FIG. 1 showing the bar of soap being reduced in size after a number of uses.

As shown in FIG. 4, after repeated uses, the body of soap 30 will diminish in size. The hourglass configuration of the gripping body 11 provides a greater amount of soap to be interconnected with itself rather than being "divided" by the gripping body 11 extending therethrough which might promote breakage if dropped. Further, the holes 17, in particular the medial holes 17 provide additional surface area for the body of soap 30 to remain interconnected on both sides 14, 15 of the gripping body 11 because the material of the soap 30 extends through the medial holes 17.

As the body of soap 30 diminishes in size, additional holes 17 become accessible and may be used as finger holes 17 as well for manipulating the body of soap 30. At such time, and if the user desires, a portion of the first end 12 and the second end 13 of the gripping body 11 may be trimmed away/cut away by a user with a scissors or similar cutting instrument. It is also contemplated a user may use the excess lengths of the gripping body 11 to enhance scrubbing of their skin—similar to use of a wash-cloth.

The holes 17 defined in the body 11 also provide a means for suspending the body of soap 30 from a hook (not shown), or other apparatus in a shower or other bathing structure to allow for drying and the like so as to minimize wastage of the body of soap 30 caused by saturation with moisture which causes many soaps to become gelatinous in texture.

Figure 2:
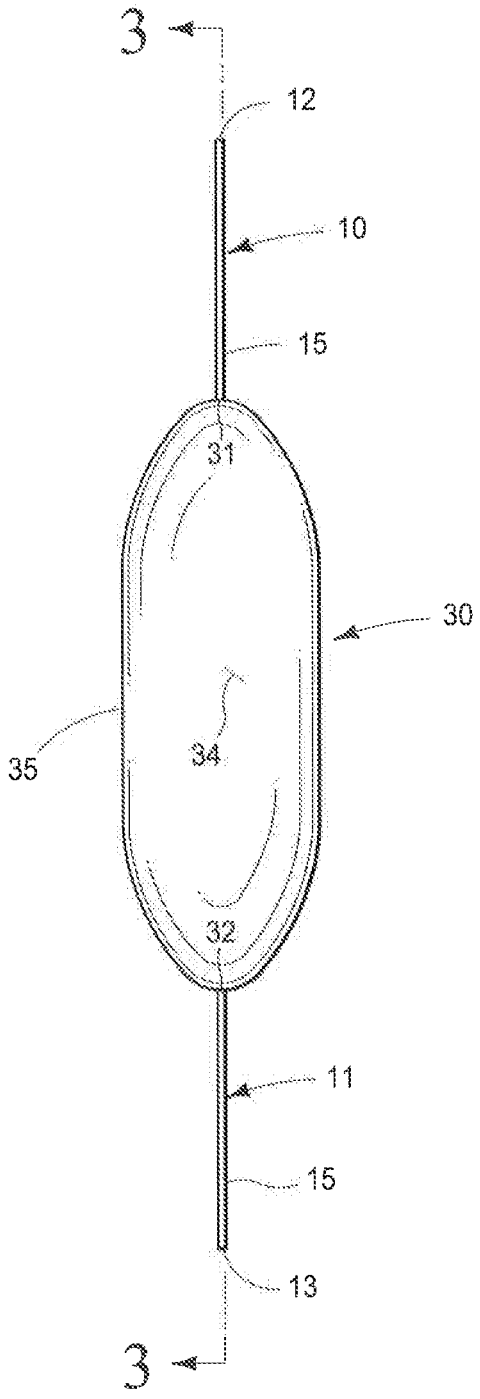
FIG. 2 is an orthographic second side view of the soap grip and body of soap of FIG. 1.

As shown in FIGS. 1 and 2, the body of soap 30 has a first end 31, a second end 32, a first side 33, a second side 34, a top surface 35, a bottom surface 36 and defines a middle portion 37 between the ends 31, 32, between the sides 33, 34 and between the top surface and the bottom surface 35, 36 respectively. Even though the body of soap 30 may diminish in size after repeated uses (FIG. 4), the ends 31, 32, the sides 33, 34 and the surfaces 35, 36 of the body of soap will remain constant.

The soap grip body 11 is incorporated into the body of soap 30 when the body of soap 30 is formed by customary practice which generally includes injection of a fluidic or semi-fluidic volume of soap (not shown) into a mold (not shown) at pressure and temperature. The fluidic or semi-fluidic volume is thereafter allowed to solidify. Positioning the flexible gripping body 11 so as to extend across a mold void (not shown) prior to injection of the soap into the mold void causes the gripping body 11 to be thoroughly incorporated into the body of soap 30 and for the soap to flow into and through the medial holes 17 and to bond with the surface texture 18 so that when the body of soap 30 is removed from the mold the gripping body 11 is integral therewith.

Additional benefits of the gripping body 11 are that the first end 12 and the second end 13 are flexible and easily manipulable. This feature allows for the bodies of soap 30 to continue to use boxes (not shown), and other containers originally designed for the bodies of soap 30 without a need to redesign or resize such containers. Further, the thickness 20 of the body 11, being minimal, will not materially affect the size of the body of soap 30, nor the weight of the body of soap 30 which may impact shipping and transportation of large quantities. Further, it is anticipated the cost of the flexible body 11 is immaterial as compared to the cost of the soap and the containers therefore.

When the body of soap 30 has been repetitively used, such that the size of the body of soap 30 is too small to be effectively used in bathing, a user would dispose of the remaining body of soap 30 and the flexible body 11 and replace it with a new body of soap 30 having a new body 11 extending therethrough.

Operation

The use of the soap grip 10 is simple and straightforward. The body of soap 30 having the flexible body 11 extending therethrough would be removed from its container (not shown) which may be a box or cellophane type wrapping.

The user would insert his/her finger through one of the holes 17 defined in the body 11 adjacent one end 31, 32 of the body of soap 30. Depending upon the size of the user's hands, a second finger (not shown) may be inserted through the finger hole 17 adjacent to the opposing end 31, 32 of the body of soap 30. The finger hole 17 having the user's fingers inserted therethrough provides a secure means to grasp and manipulate the body of soap 30 during bathing which allows the user to move the body of soap 30 upon and across the user's body as desired with the top surface 35, or bottom surface 36 directionally frictionally contacting the user's skin/body to cause lathering thereof while bathing. The body of soap 30 should be wetted prior to manipulating it across the user's skin to avoid uncomfortable friction and to make the body 30 slippery.

When the user is finished lathering his/her body, the user would remove his/her fingers from the finger holes 17 and hang the body of soap 30 and soap grip 10 from a hook (not shown) or other protuberance provided for in the bathing structure so that the body of soap 30 and soap grip 10 are suspended therefrom without direct contact with a soap dish (not shown) or other fluid retaining structure within the bathing structure so that air may completely surround the body of soap 30 to enhance drying and preservation of the soap when not in use, thus conserving soap for subsequent uses.

A soap grip 10 for a bar of soap provides a gripping body 11 that extends through a medial portion 37 of a body of soap 30 so as to extend from a first end 31 and a second end 32 thereof, the gripping body 11 provides finger holes 17 to allow for secure gripping of the body of soap 30 while bathing.

The invention is a soap grip 10 for a body of soap 30, the body of soap 30 having a first end 31, a second end 32, a first side 33, a second side 34, a top surface 35, and a bottom surface 36 with a medial portion 37 between the opposing ends 31, 32 and the opposing sides 33, 34. The soap grip 10 provides a flexible planar gripping body 11 having a first end 12, a second end 13, a first side 14 and a second side 15 with a width 16 therebetween and the gripping body 11 defines plural spaced apart holes 17 between the first end 12 and the second end 13 and between the first side 14 and the second side 15, and the gripping body 11 is carried within the body of soap 30 passing through the middle portion 37 thereof so as to extend outwardly from an end 31, 32 of the body of soap 30 and one hole 17 defined in the gripping body 11 is outward of the end 31, 32 of the body of soap 30.

The gripping body 11 may extend outwardly from both the first end 31 and the second end 32 of the body of soap 30, and a hole 17 defined in the gripping body 11 is outward of each end 31, 32 of the body of soap 30.

The gripping body 11 width 19 between the first side 14 and the second side 15 is reduced between the first end 12 and the second end 13.

The holes 17 defined in the gripping body 11 are finger holes.

The soap grip 11 has a surface texture 18 extending entirely thereabout that enhances engagement with the body of soap 30.

The soap grip 11 is incorporated into a body of soap 30 when the body of soap 30 is formed.

The soap grip 10 is formed of a flexible generally planar fabric gripping body 11 having a surface texture 18 that enhances engagement with a body of soap 30, the gripping body 11 having a first end 12 and a second end 13, a first side 14 and a second side 15 with a width 16 between the first side 14 and the second side 15 and the gripping body 11 defines plural spaced apart finger holes 17 between the first end 12 and the second end 13 and between the first side 14 and the second side 15 and the width 19 of the gripping body 11 is reduced at a medial portion between the first end 12 and the second end 13, and the body of soap 30 has a first end 31, a second end 32, a first side 33, a second side 34, a top surface 35 and a bottom surface 36 with a medial portion 37 between the first end 31 and the second end 32 and between the first side 33 and the second side 34 and between the top surface 35 and the bottom surface 36, and the gripping body 11 is carried within the body of soap 30 and passes through the middle portion 37 thereof so as to extend outwardly from the first end 31 and the second end 32 thereof, and one finger hole 17 defined in the gripping body 11 is positioned outwardly of each end 31, 32 of the body of soap 30 so as to be accessible for gripping and manipulating the body of soap 30.

I claim:

1. A soap gripping apparatus comprising:

a body of soap having a first end, a second end, a first side, a second side, a top surface, a bottom surface, and a medial portion between the first end and the second end, between the first side and the second side, and between the top surface and the bottom surface; and a flexible, generally planar, gripping body comprising non-woven fabric material having a first end, a second end, a first side, and a second side, and a width between the first side and the second side, the gripping body defining a plurality of spaced apart holes between the first end and the second end and between the first side and the second side;

wherein the gripping body is located within the body of soap, passes through the medial position, extends outwardly from one end of the body soap, and includes a first hole of the plurality of spaced apart holes outward of the first end of the body of soap, and a second hole outward of the second end of the body of soap; and wherein the first hole is amply sized to receive a user's finger and provide a secure means of gripping the body of soap.

2. The soap gripping apparatus of claim 1 wherein the width of the gripping body is reduced between the first end and the second end of the gripping body.

3. The soap gripping apparatus of claim 1 further comprising a surface texture extending entirely about the gripping body that enhances engagement with the body of soap.

4. The soap gripping apparatus of claim 1, wherein the non-woven material comprises cotton.

5. The soap gripping apparatus of claim 1, wherein the non-woven material comprises Tyvek.

6. The soap gripping apparatus of claim 1, wherein the gripping body has an hourglass shape.

7. A soap gripping apparatus comprising:

a flexible, generally planar, non-woven fabric gripping body having a rough surface texture extending entirely thereabout, a first end, a second end, a first side, a second side, and a width between the first side and the second side, the gripping body defining a plurality of spaced apart finger holes between the first end and the second end and between the first side and the second side, and wherein the width of the gripping body is reduced at a medial portion between the first end and the second end; and a body of soap having a first end, a second end, a first side, a second side, a top surface, a bottom surface, and a medial portion between the first end and the second end, between the first side and the second side, and between the top surface and the bottom surface;

wherein the gripping body is carried within the body of soap, passes through the medial portion of the body of soap, extends outwardly from the first end and the second end of the body of soap, includes a first hole of the plurality of spaced apart holes outward of the first end of the body of soap, and includes a second hole of the plurality of spaced apart holes outward of the second end of the body of soap; and wherein the first hole is amply sized to receive a user's finger and provide a secure means of gripping the body of soap.

* * * * *